US011512381B2

(12) United States Patent
Lapierre et al.

(10) Patent No.: US 11,512,381 B2
(45) Date of Patent: Nov. 29, 2022

(54) METHOD AND FACILITY FOR CARBONITRIDING ONE OR MORE STEEL PARTS UNDER LOW PRESSURE AND AT A HIGH TEMPERATURE

(71) Applicant: ECM Technologies, Grenoble (FR)

(72) Inventors: Philippe Lapierre, Exincourt (FR); Jerome Lardinois, Trevenans (FR)

(73) Assignee: ECM TECHNOLOGIES SAS, Grenoble (FR)

( * ) Notice: Subject to any disclaimer, the term of this patent is extended or adjusted under 35 U.S.C. 154(b) by 1232 days.

(21) Appl. No.: 15/526,272

(22) PCT Filed: Oct. 12, 2015

(86) PCT No.: PCT/FR2015/052742
§ 371 (c)(1),
(2) Date: Jul. 26, 2018

(87) PCT Pub. No.: WO2016/075377
PCT Pub. Date: May 19, 2016

(65) Prior Publication Data

US 2018/0363123 A1 Dec. 20, 2018

(30) Foreign Application Priority Data

Nov. 14, 2014 (FR) ..... 1460975

(51) Int. Cl.
*C23C 8/34* (2006.01)
*C21D 1/74* (2006.01)
(Continued)

(52) U.S. Cl.
CPC ..... *C23C 8/34* (2013.01); *C21D 1/74* (2013.01); *C21D 9/0062* (2013.01); *C23C 8/02* (2013.01);
(Continued)

(58) Field of Classification Search
CPC ..... C23C 8/34; C21D 1/74
(Continued)

(56) References Cited

U.S. PATENT DOCUMENTS 3,870,572 A * 3/1975 Brugger ..... C23C 8/32 148/218
6,451,137 B1 9/2002 Pelissier
(Continued)

FOREIGN PATENT DOCUMENTS

DE 10 2013 006589 A1 10/2014
EP 1 101 826 A1 5/2001
(Continued)

OTHER PUBLICATIONS

International Search Report corresponding to PCT/FR2015/052742 dated Feb. 3, 2016.
(Continued)

*Primary Examiner* — Weiping Zhu
(74) *Attorney, Agent, or Firm* — Moreno IP Law LLC

(57) ABSTRACT

The invention relates to a carbonitriding facility (IC) which includes: a heating chamber (CC), for heating at least one steel part (PA) to a first temperature, in the presence of a neutral gas and under a selected pressure; a first enriching chamber (CE1) for enriching the heated part with nitrogen, by nitriding same in α-phase at a second temperature no higher than the first temperature; a second enriching chamber (CE2) for enriching the nitrogen-enriched part with carbon, by carburising same at a third temperature higher than the second temperature; a quench chamber (CT) for quenching the nitrogen- and carbon-enriched part under pressure; a transfer airlock (ST) communicating with the chambers and suitable for temporarily receiving the part in
(Continued)

a controlled atmosphere; and transfer means (MT) for transfer-ring the part from one chamber to another chamber via the transfer airlock (ST).

10 Claims, 2 Drawing Sheets

(51) Int. Cl.

| | |
|---|---|
| ***C21D 9/00*** | (2006.01) |
| ***C23C 8/02*** | (2006.01) |
| ***C23C 8/80*** | (2006.01) |
| ***F27D 3/04*** | (2006.01) |
| ***F27B 5/04*** | (2006.01) |
| ***F27B 19/02*** | (2006.01) |
| *C21D 1/06* | (2006.01) |

(52) U.S. Cl.
CPC ..... *C23C 8/80* (2013.01); *F27B 5/04* (2013.01); *F27B 19/02* (2013.01); *F27D 3/04* (2013.01); *C21D 1/06* (2013.01)

(58) Field of Classification Search
USPC ..... 148/219
See application file for complete search history.

(56) References Cited

U.S. PATENT DOCUMENTS

| | | | |
|---|---|---|---|
| 2011/0036462 | A1 | 2/2011 | Berlier et al. |
| 2014/0238549 | A1 | 8/2014 | Lapierre et al. |

FOREIGN PATENT DOCUMENTS

| | | | | |
|---|---|---|---|---|
| FR | 2 884 523 | A1 | | 10/2006 |
| FR | 2 981 947 | A1 | | 5/2013 |
| JP | 11021631 | A | | 1/1999 |
| JP | 2006028541 | A | * | 2/2006 |
| JP | 2006028541 | A | | 2/2006 |
| WO | 2011009463 | A1 | | 1/2011 |
| WO | 2014/170566 | A1 | | 10/2014 |

OTHER PUBLICATIONS

Written Opinion corresponding to PCT/FR2015/052742 dated Feb. 3, 2016.

* cited by examiner

METHOD AND FACILITY FOR CARBONITRIDING ONE OR MORE STEEL PARTS UNDER LOW PRESSURE AND AT A HIGH TEMPERATURE

CROSS-REFERENCE TO RELATED APPLICATIONS

This application is the US National Stage under 35 U.S.C. § 371 of International App. No. PCT/FR2015/052742 filed on Oct. 12, 2015, and which claims priority to French App. No. 1460975 filed on Nov. 14, 2014, both of which are incorporated herein by reference.

BACKGROUND

The application relates to certain thermo-chemical treatments which are intended to reinforce steel parts, and more specifically to the carbonitriding of such steel parts.

In certain fields such as, for example, that of vehicles and perhaps also automobiles, it is essential to reinforce the strength of certain steel parts, and more precisely at least their resistance to fatigue, so that they can withstand significant stresses and/or in order to increase their lifespan. Such reinforcement can be achieved by carbonitriding.

It is known that carbonitriding is a thermochemical diffusion treatment which includes enriching the surface of a steel with carbon and nitrogen, before a quenching step, so as to obtain a martensitic structure and reinforcement. The enrichment of nitrogen, here carried out in the austenitic phase, is called α-phase nitriding, and the carbon enrichment is called carburization. The α-phase (or austenitic phase) nitriding is intended to improve the fatigue strength and the stability of the metallurgical structure of the steel by penetration of nitrogen.

Carburizing involves introducing carbon into a steel part in order to increase its ability to be soaked and therefore to increase its surface hardness and its fatigue and wear resistance.

Quenching is a rapid cooling in a liquid or gaseous medium which causes the appearance of a martensitic structure having a very elevated hardness.

As known to those skilled in the art, the known carbonitriding treatments take a long time and give non-optimal metallurgical results because they result from compromises.

Indeed, they use relatively low processing temperatures (typically about 850° C.) in order to optimize nitrogen enrichment (and more precisely to avoid that the greater part of the ammonia ($NH_3$) of nitriding in α-phase does not crack even before touching the part), but at the expense of carbon enrichment (which requires higher temperatures) and processing time (which must be increased due to the relatively low processing temperature).

SUMMARY

The object is therefore to improve the situation.

In particular, a method is disclosed for the carbonitriding of at least one steel part, the method comprising:

a first step in which each part is heated to a first selected temperature in an environment containing an inert gas and under a selected pressure, a second step in which the heated part is nitrogen-enriched in a first chamber, by nitriding in α-phase at a second selected temperature less than or equal to the first temperature, a third step in which the part enriched in nitrogen is enriched with carbon in a second chamber, by carburizing at a third selected temperature appropriately higher than the second temperature; and a fourth step in which the nitrogen and carbon enriched part is quenched under pressure.

Because the temperature of the part is hotter than that at which the α-phase nitriding is carried out, cracking of the nitriding gas instantaneously upon contact is avoided and therefore the nitriding gas is made much more available for use as enriching nitrogen. Moreover, this allows a better diffusion of the nitrogen in the part and therefore an increase in its concentration. In addition, since the carburization is carried out at a temperature higher than that of the α-phase nitriding, the carbon enrichment of the part is thus more efficient and faster. Finally, since the carbon enrichment step is carried out in a chamber different from that in which the nitrogen enrichment step is carried out, it possible to very rapidly vary the temperature between the carbon and nitrogen enrichment steps.

The method may comprise other characteristics which may be taken separately or in combination, and in particular:

in the first step the inert gas may be nitrogen gas ($N_2$);

in the first step the pressure may be between about 1 bar and about 1.5 bars. However, it could be significantly lower and, for example, similar to the low pressure used in the second and third steps;

in the first step the first temperature can be between about 800° C. and about 1100° C.;

in the second step, the second temperature may be set from about 700° C. to about 880° C.;

in the second step, the part may be enriched with nitrogen by nitriding in the α-phase with ammonia;

in the third step the third temperature may be between about 900° C. and about 1100° C.;

in the third step, the carbon part can be enriched by carburizing with acetylene;

in the fourth step the quenching pressure may be between about 1 bar and about 20 bars;

in the fourth step the quenching can be carried out in an environment containing a selected gas.

An installation is also disclosed which dedicated to the carbonitriding of steel parts, and comprising:

at least one heating chamber suitable for heating at least one steel part at a selected first temperature in an environment containing an inert gas and under a selected pressure, at least one first enrichment chamber suitable for enriching the heated part with nitrogen, by nitriding in the α-phase at a second selected temperature less than or equal to the first temperature, at least one second enrichment chamber suitable for carbon enriching the part enriched in nitrogen, by carburizing at a third selected temperature appropriately higher than the second temperature, at least one quenching chamber suitable for quenching under pressure the nitrogen and carbon enriched part, a transfer lock communicating in a controlled manner with each of the chambers and adapted to temporarily accommodate the part in an environment where a controlled atmosphere prevails, and a transfer means adapted to transfer the part from one chamber to another chamber via the transfer lock.

DESCRIPTION OF THE FIGURES

Other characteristics and advantages of the method and installation will appear upon examining the detailed description below and the accompanying drawings, in which.

DETAILED DESCRIPTION

A method and an associated facility IC are disclosed which allow carbonitriding of part(s) made of steel PA at high temperature and at low pressure.

In the following it is considered, by way of non-limiting example, that the steel parts PA are intended to be fitted to a vehicle, possibly of the automotive type. For example, they may be gearbox parts, transmission parts, or various gears. But the method is not limited to this application. The method concerns any steel part intended to equip a device, an apparatus, a system (and in particular a vehicle, whatever the type), or a facility (possibly of an industrial type). The method thus also relates in particular to certain transmission elements in the aeronautical field, and generally to parts which are mechanically stressed in wear and fatigue.

A method of carbonitriding steel part(s) PA comprises at least first, second, third and fourth steps.

Figure 1:
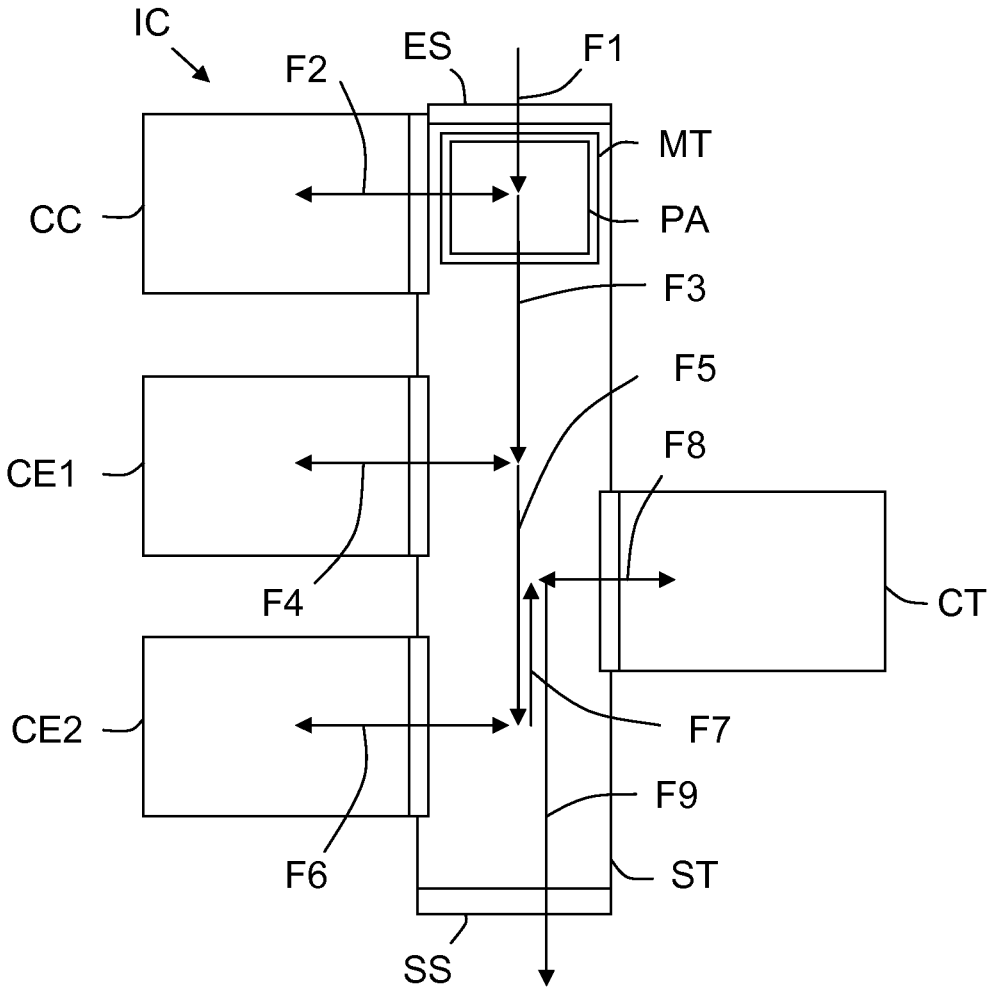
FIG. 1 schematically and functionally illustrates an exemplary embodiment of a carbonitriding facility, and FIG. 2 schematically illustrates an example of a flow chart implementing the carbonitriding method.

Such a method can be implemented by a carbonitriding installation IC of the type which is illustrated without limitation in FIG. 1.

As illustrated in FIG. 1, a carbonitriding facility IC comprises at least one heating chamber CC, at least one first enrichment chamber CE1, at least one second enrichment chamber CE2, at least one quenching chamber CT, a transfer chamber ST, and a transfer means MT.

The transfer lock ST comprises an input ES with controlled access and through which are introduced each part (of steel) PA to be treated, and an output SS with controlled access and by which the part PA treated is extracted. For example, the input ES and the output SS each comprise a single or double sliding door, sealed, electrically or pneumatically controlled, and providing the sealed interface. This transfer lock ST communicates in a controlled manner with each of the chambers CC, CE1, CE2 and CT, and is adapted to temporarily accommodate the part PA, during each of its transfers from one chamber to another, in an environment where a controlled atmosphere prevails to avoid oxidation.

This controlled atmosphere may be a vacuum, selected preferably between about 2 millibars and about 50 millibars, and it may be inert (for example defined by an inert gas such as nitrogen gas ($N_2$)).

It will be noted that each part PA is preferably placed on a plate which can accommodate one or more parts to be treated. It is to be considered in the following, by way of illustrative example, that only one part PA is treated at a time.

The (each) heating chamber CC is arranged so as to heat a part PA at a selected first temperature T1 in an environment which contains an inert gas and under a selected pressure P1. It comprises means of access control such as, for example, a single or double sliding door, sealed, controlled electrically or pneumatically, and providing the sealed interface with the transfer lock ST.

For example, the inert gas may be nitrogen gas (N2). Also, for example, the pressure P1 can be substantially equal to the atmospheric pressure. It may thus, for example, be between about 1 bar and about 1.5 bars. However, in a more economical variant, this pressure P1 can be similar (or identical) to the low pressure which is used in the enrichment chambers CE1 and CE2 (typically a few millibars).

The first temperature T1 is preferably between about 800° C. and about 1100° C. It can, for example, be selected to be equal to 1050° C.

The (each) first enrichment chamber CE1 is arranged in such a way as to nitrogen enrich under low pressure the part PA which has been heated in the heating chamber CC by nitriding in the αphase at a second temperature T2, selected less than or equal to the first temperature T1 (i.e. T2 T1). Preferably, this second temperature T2 is appropriately lower than the first temperature T1 (i.e. T2<T1). The first enrichment chamber comprises means of access control such as, for example, a single or double sliding door, sealed, controlled electrically or pneumatically, and providing the sealed interface with the transfer lock ST.

The second temperature T2 is preferably between about 700° C. and about 880° C. It can be selected, for example, to be equal to 830° C.

For example, to achieve nitrogen enrichment by nitriding in the α-phase, gaseous ammonia ($NH_3$) can be used. This gas constitutes the atmosphere inside the first enrichment chamber CE1.

The (each) second enrichment chamber CE2 is arranged so as to carbon enrich, under a low pressure, the part PA which has been nitrogen enriched in the first enrichment chamber CE1 by carburizing under a third temperature T3 selected appropriately higher than the second temperature T2 (i.e. T3>T2). The second enrichment chamber comprises means of access control such as, for example, a single or double sliding door, sealed, controlled electrically or pneumatically, and providing the sealed interface with the transfer lock ST.

Preferably, the third temperature T3 is set between about 900° C. and about 1100° C. For example, it can be selected to be equal to 1050° C.

For example, to achieve carbon enrichment by carburizing, acetylene ($C_2H_2$) gas can be used. This gas constitutes the atmosphere inside the second enrichment chamber CE2. Other carburizing gases can be used, however, and in particular propane.

The (each) quenching chamber CT is arranged so as to quench under pressure the part PA which has been nitrogen and carbon enriched in the first CE1 and second CE2 enrichment chambers. This quenching is preferably carried out under a fourth selected temperature T4, close to room temperature and under a pressure P2 which is greater than or equal to atmospheric pressure. It comprises means of access control such as, for example, a single or double sliding door, sealed, controlled electrically or pneumatically, and providing the sealed interface with the transfer lock ST.

For example, the quenching pressure P2 may be from about 1 bar to about 20 bars. The quenching pressure may be thus selected, for example, to be equal to about 15 bars for steels containing little alloy.

It will be noted that the increase in the quenching pressure makes it possible to quench the parts PA more strongly, but causes more deformations. The choice of the pressure is therefore a compromise between the hardness of the steel, the deformations and the hardness that it is intended to obtain.

The quenching can be carried out by immersion in an environment which contains a selected gas such as, for example, nitrogen or helium. The quenching gas thus constitutes the atmosphere inside the quenching chamber CT.

Quenching can alternatively be accomplished by immersion in an environment which contains a selected liquid such as, for example, oil or a polymer.

The transfer means MT is arranged so as to transfer the part PA from one chamber to another chamber via the transfer lock ST. The transfer means comprises, for example, a motorized carriage (preferably electrically), comprising a plate suitable for supporting at least one part PA, and mounted in translation on rails which are fixedly installed in the transfer lock ST and which communicate with the outside (via the input ES and output SS of the transfer lock ST) and with the various chambers CC, CE1, CE2 and CT in order to allow the transfer of the part PA.

A first step of the method is carried out once at least one part PA has been installed in the (a) heating chamber CC via the transfer means MT (arrows F1 and F2 of FIG. 1). This installation corresponds to sub-step 20 of the exemplary flow chart of FIG. 2.

In this first step, the part PA is heated to the selected first temperature T1, in an environment containing an inert gas (such as, for example, nitrogen gas, as mentioned above) and under a selected pressure P1 (if need be substantially equal to atmospheric pressure).

Such heating in an inert atmosphere and under a low pressure makes it possible to have a heating rate of the part PA substantially faster than in the case of heating under vacuum. For example, to raise the temperature of a part PA to about 1050° C. in an inert atmosphere and under about 1 bar, it takes about one hour, whereas it takes about one and a quarter hours under vacuum. This allows the heating chamber CC to be cleared more quickly.

Figure 2:
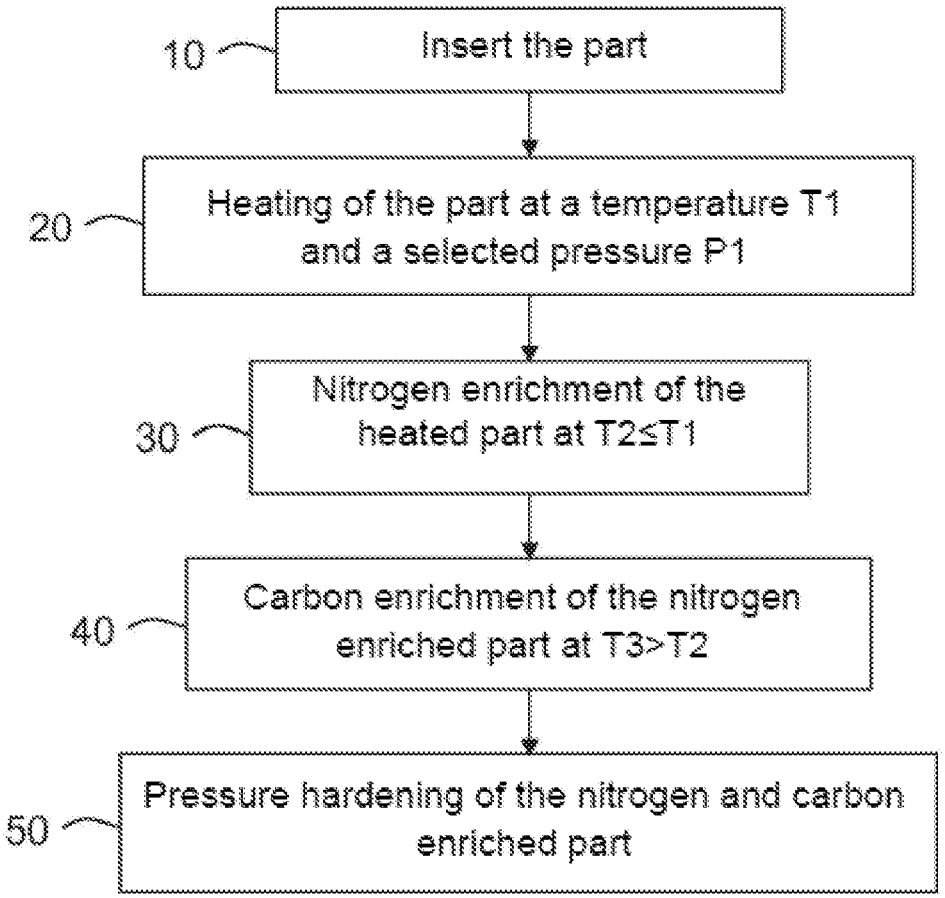

The first step corresponds to sub-step 20 of the exemplary flow chart of FIG. 2.

A second step of the method is carried out once the part PA has been heated to the first temperature T1 in the heating chamber CC, and then installed in the first enrichment chamber CE1 via the transfer means MT (arrows F2, F3 and F4 in FIG. 1).

In this second step, the heated part PA is nitrogen enriched under low pressure (typically a few millibars) by nitriding in the α-phase under the second selected temperature T2 (less than or equal to the first temperature T1, and preferably appropriately lower than T1).

Since the temperature T1 of the part PA is preferably initially hotter than the temperature T2, at which the nitriding is carried out in the αphase, one avoids the nitriding gas cracking instantly upon contact and therefore makes this gas much more available for nitrogen enrichment. Furthermore, this allows a better diffusion of the nitrogen in the part PA and therefore an increase in its concentration, according to the Fick's Law.

It will be noted that maximum nitrogen enrichment of the part PA is expected between about 800° C. and about 850° C., when ammonia is used as the nitriding gas. Indeed, beginning from about 900° C., 99% of the ammonia cracks instantaneously in the atmosphere and is no longer available to nitrogen enrich the part PA.

It will also be noted that the duration of the nitriding in the α-phase may be equal to approximately ten minutes. This duration is a function of the quantity of nitrogen that it is desired to introduce into the part PA.

At the end of the nitriding in α-phase, the temperature of the part PA has become slightly less than T1, because the nitriding temperature T2 in αphase is appropriately less than T1. For example, if T1 is equal to 1050° C., and the nitriding temperature in αphase is equal to 830° C., the temperature of the nitrogen enriched part PA enriched is about 1010° C. after ten minutes of α-phase nitriding.

The second step corresponds to the sub-step 30 of the exemplary flow chart in FIG. 2.

A third step of the method is carried out once the part PA has been nitrogen enriched in the first enrichment chamber CE1 and then installed in the second enrichment chamber CE2 via the transfer means MT (arrows F4, F5 and F6 of FIG. 1).

In this third step, the already nitrogen enriched part PA is carbon enriched under low pressure (typically a few millibars), by carburizing under the third selected temperature T3 (appropriately higher than the second temperature T2). The higher the third carburizing temperature T3, the more efficient and rapid the carbon enrichment of the part PA. For example, in order to obtain a so-called E650 depth of 0.4 mm by carburizing, it takes about 210 minutes of treatment when the third carburizing temperature T3 is equal to 900° C., whereas it takes only 15 minutes when the third carburizing temperature T3 is equal to 1050° C.

It will be noted, however, that it is not recommended to use a third carburizing temperature T3 greater than 1100° C., since this induces a strong degradation of the metallurgy of the steels by magnification of the grain. Moreover, for the third carburizing temperatures T3 above 950° C., it is preferable to initially add to the steel of part PA, alloying elements (such as, for example, niobium) in order to prevent the magnification of grains.

It will also be noted that the duration of the third step may be equal to about fifteen minutes (ten minutes for the acetylene effective carburization, and then five minutes for the complete diffusion of carbon in the part PA under nitrogen). This duration is a function of the desired processing depth in the part PA.

At the end of the carburization, the temperature of the part PA has become equal to T3 because the carburizing temperature T3 is appropriately higher than that which it presents at the outlet of the first enrichment chamber CE1.

The third step corresponds to sub-step 40 of the exemplary flow chart of FIG. 2.

A fourth step of the method is carried out once the part PA has been nitrogen and carbon enriched in the first CE1 and second CE2 enrichment chambers, and then installed in the quenching chamber CT via the transfer means MT (arrows F6, F7 and F8 of FIG. 1).

In this fourth step, the nitrogen and carbon enriched part PA is rapidly quenched (or cooled) under pressure P2. The fourth quenching temperature T4 is, for example, room temperature, typically about 20° C.

The quenching pressure P2 used is preferably between about 1 bar and about 20 bars. These values, which are much higher than those of the low pressure used in the second and third steps, make it possible to increase the cooling rate. A very fast rate makes it possible to transform the nitrogen and carbon enriched austenite, in order to form martensite and to increase substantially the hardness of the part PA.

It will be noted that the duration of the quenching can be between about 2 minutes and about 5 minutes. This duration is mainly a function of the dimensions of the parts PA to be treated and the initial chemical composition of the steel.

The fourth step corresponds to sub-step 50 of the exemplary flow chart of FIG. 2.

At the end of the quenching, the part PA is exited from the heating chamber CC and then from the transfer lock ST (via its outlet SS) via the transfer means MT (arrows F8 and F9 in FIG. 1).

It will also be noted that the carbonitriding installation IC may optionally comprise at least one other heating chamber CC in order to allow virtually continuous feeding of the first enrichment chamber CE1, in which the treatment time is significantly shorter than the heating time, and/or at least one further first enrichment chamber CE1 for the parallel treatment of a number of parts PA and/or for enrichment of additional nitrogen, and or at least one further second enrichment chamber CE2 for treating several parts PA in parallel and/or for carrying out additional carbon enrichment, and/or at least one other quenching chamber CT for treating a number of parts PA in parallel. In particular, it is possible to consider carrying out a second nitriding in αphase after the carburization, in order to obtain a high nitrogen concentration on the surface of the part PA.

The method has several advantages, among which:

a significant reduction in processing time compared to conventional carbonitriding, a significant reduction in gas consumption, a reduction in the number of technicians needed to control the carbonitriding facility, a possibility of just-in-time production, a significant increase in the nitrogen content in the part, and thus an improvement in its functional characteristics (and mainly in its fatigue strength), the obtaining of parts exhibiting virtually identical properties, a reduction in the cost of treatment.

The invention claimed is:

1. A method for carbonitriding at least one steel part, wherein the method comprises:

a first step in which said at least one steel part is heated to a first selected temperature in an inert environment and under a selected pressure;

a second step in which the at least one steel part that was heated in the first step is nitrogen enriched in a first enrichment chamber by phase nitriding at a second selected temperature less than said first temperature;

a third step in which the at least one steel part that was nitrogen enriched in the second step is carbon enriched in a second enrichment chamber by carburizing under a third selected temperature higher than said second temperature; and a fourth step in which said at least one steel part which has been nitrogen and carbon enriched is quenched under pressure.

2. The method according to claim 1, wherein in said first step said inert environment is nitrogen gas.

3. The method according to claim 1, wherein in said first step, said first temperature is between about 800° C. and about 1100° C.

4. The method according to claim 1, wherein in said second step, said second temperature is between about 700° C. and about 880° C.

5. The method according to claim 1, wherein in said second step, the at least one steel part is nitrogen enriched by nitriding in the α-phase with ammonia.

6. The method according to claim 1, wherein in said third step, said third temperature is between about 900° C. and about 1100° C.

7. The method according to claim 1, wherein in said third step, said at least one steel part is enriched with carbon by carburizing with acetylene.

8. The method according to claim 1, wherein in said fourth step, said quenching pressure is between about 1 bar and about 20 bars.

9. The method according to claim 1, wherein in said fourth step, said quenching is carried out in an environment containing a selected gas.

10. A method for carbonitriding at least one steel part, wherein the method comprises:

a first step in which said at least one steel part is heated to a first selected temperature in an environment containing an inert gas and under a selected pressure;

a second step in which the at least one steel part that was heated in the first step is nitrogen enriched in a first enrichment chamber by phase nitriding at a second selected temperature less than said first temperature, wherein the first temperature is higher than a cracking temperature of a nitriding gas used in the second step and the second temperature is less than the cracking temperature;

a third step in which the at least one steel part that was nitrogen enriched in the second step is carbon enriched in a second enrichment chamber by carburizing under a third selected temperature higher than said second temperature; and a fourth step in which said at least one steel part which has been nitrogen and carbon enriched is quenched under pressure.

* * * * *